US010125792B2

(12) United States Patent
Nakano

(10) Patent No.: US 10,125,792 B2
(45) Date of Patent: Nov. 13, 2018

(54) CENTRIFUGAL PUMP

(71) Applicant: Kabushiki Kaisha Saginomiya Seisakusho, Tokyo (JP)

(72) Inventor: Seiichi Nakano, Sayama (JP)

(73) Assignee: KABUSHIKI KAISHA SAGINOMIYA SEISAKUSHO, Tokyo (JP)

( * ) Notice: Subject to any disclaimer, the term of this patent is extended or adjusted under 35 U.S.C. 154(b) by 246 days.

(21) Appl. No.: 14/158,338

(22) Filed: Jan. 17, 2014

(65) Prior Publication Data

US 2014/0205480 A1 Jul. 24, 2014

(30) Foreign Application Priority Data

Jan. 23, 2013 (JP) ..... 2013-010102

(51) Int. Cl.
*F04D 29/62* (2006.01)
*F04D 29/42* (2006.01)
(Continued)

(52) U.S. Cl.
CPC ..... *F04D 29/628* (2013.01); *F04D 13/0633* (2013.01); *F04D 29/026* (2013.01);
(Continued)

(58) Field of Classification Search
CPC .... F04D 29/002; F04D 29/005; F04D 29/007; F04D 29/02; F04D 29/023; F04D 29/026; F04D 29/08; F04D 29/083; F04D 29/086; F04D 29/16; F04D 29/161; F04D 29/165; F04D 29/40; F04D 29/403; F04D 29/406;
(Continued)

(56) References Cited

U.S. PATENT DOCUMENTS 3,059,582 A * 10/1962 Greene ..... F04D 29/426 285/367
4,172,695 A * 10/1979 Uesugi ..... F04D 29/426 415/127
(Continued)

FOREIGN PATENT DOCUMENTS

GB 2488219 A 8/2012
JP 06-074197 A 3/1994
(Continued)

*Primary Examiner* — Devon Kramer
*Assistant Examiner* — Chirag Jariwala
(74) *Attorney, Agent, or Firm* — Snyder, Clark, Lesch & Chung, LLP

(57) ABSTRACT

A centrifugal pump includes a main body casing. The main body casing includes an upper main body casing, a lower main body casing fixed to the upper main body casing, and a blade casing. In the blade casing, an interior space S1 formed by the upper main body casing and the lower main body casing is partitioned, and a fluid introducing passage is formed on the upper portion and a rotating accommodating space S2 to accommodate the rotating blade member is formed on lower portion. A joint portion of the upper main body casing, the lower main body casing, and the blade casing is fixed on the state of sealing. A joint portion of the suction side coupling member and the main body casing and a joint portion of the discharge side coupling member and the main body casing 34 are fixed on the state of sealing.

13 Claims, 9 Drawing Sheets

(51) Int. Cl.
*F04D 13/06* (2006.01)
*F04D 29/02* (2006.01)
*F04D 29/046* (2006.01)

(52) U.S. Cl.
CPC ..... *F04D 29/0467* (2013.01); *F04D 29/426* (2013.01); *F04D 29/4266* (2013.01); *F04D 29/4273* (2013.01); *F04D 29/4293* (2013.01); *F05D 2230/232* (2013.01); *F05D 2260/33* (2013.01); *F05D 2300/10* (2013.01)

(58) Field of Classification Search
CPC ..... F04D 29/05; F04D 29/053; F04D 29/054; F04D 29/42; F04D 29/4206; F04D 29/4213; F04D 29/4266; F04D 29/4233; F04D 29/424; F04D 29/4246; F04D 29/4253; F04D 29/426; F04D 29/4293; F04D 29/60; F04D 29/601; F04D 29/605; F04D 29/62; F04D 29/622; F04D 29/624; F04D 29/626; F04D 29/628; F04D 29/04; F04D 29/043; F04D 29/044; F04D 29/046; F04D 13/06; F04D 25/06; F04D 25/0606
See application file for complete search history.

(56) References Cited

U.S. PATENT DOCUMENTS 5,030,061 A * 7/1991 Meissgeier ..... F04D 29/4266 415/203
5,310,310 A * 5/1994 Nakatsukasa ..... F04D 29/605 415/206
5,385,444 A * 1/1995 Kobayashi ..... F04D 1/006 415/182.1
5,873,698 A * 2/1999 Thalmann ..... F04D 29/167 415/170.1
7,481,617 B2 * 1/2009 Hsu ..... F04D 29/4213 415/184
7,520,720 B2 * 4/2009 Welch ..... F04D 1/063 415/199.1
7,866,944 B2 * 1/2011 Kenyon ..... A61M 16/0057 415/199.2
8,985,969 B2 * 3/2015 Hoshi ..... F04D 13/02 417/360
2003/0179963 A1 * 9/2003 Hokkirigawa ..... C08K 3/04 384/97
2004/0234389 A1 * 11/2004 Hatano ..... F04D 13/0606 417/370
2011/0083828 A1 * 4/2011 Matsunaga ..... F04D 29/628 165/104.19
2012/0199129 A1 * 8/2012 Kenyon ..... A61M 16/0066 128/205.25
2013/0195696 A1 * 8/2013 Sugimura ..... H02K 5/128 417/410.1
2014/0294626 A1 * 10/2014 Aso ..... F04D 13/0606 417/410.1

FOREIGN PATENT DOCUMENTS

JP 07-017989 U 3/1995
JP H 07-17989 U * 3/1995
JP 2003-13878 A 1/2003
JP 2003-161284 A 6/2003
JP 2005-517126 A 6/2005
JP 2006250066 A * 9/2006
JP 2011-152492 A 8/2011
WO 2012108475 A1 8/2012

* cited by examiner

CENTRIFUGAL PUMP

TECHNICAL FIELD

The invention relates to a centrifugal pump to supply a fluid, which is a cooling water of various machines such as a personal computer, a computer server, and a printer, and a cooling water such as internal combustion engine, and a refrigerant used for a refrigerant circulation circuit etc. of an air conditioning machine such as an air conditioner and a freezer.

BACKGROUND ART

Conventionally, for instance, as a centrifugal pump to cool a small machine such as a cooling water of comparatively small machine such as a personal computer, a computer server and a printer, as described in Patent Document 1 (JP 2003-13878, A), a centrifugal pump is disclosed.

The centrifugal pump in Patent Document 1 is a centrifugal pump, in which a structure of an impeller is improved to form a plurality of passage portion that is radially extended from the center thereof where the fluid is flown.

As a result, the circulation volume change of cooling water is a little and the change in the cooling capability is hardly occurred.

Moreover, in Patent Document 2 (JP 2003-161284, A), an impeller is formed such that a multitude of blade is formed on the outer periphery and a rotor magnet is provided on the inner periphery, and a motor stator is disposed on the inner periphery side of the rotor magnet.

As a result, a thin centrifugal pump that can achieve an efficient cooling while attaining reducing the thickness is disclosed.

Prior Art Reference

Patent Document

[Patent Document 1]
JP 2003-13878, A
[Patent Document 2]
JP 2003-161284, A

SUMMARY OF INVENTION

Problems to be Solved by the Invention

However, such a conventional centrifugal pump can be applied to cooling of a comparatively small machine.

It is not a strong airtight structure so that it is unsuitable to use for the fluid in which the resisting pressure and the air-tight are required, for example, a cooling water such as internal combustion engine, and a refrigerant used for a refrigerant circulation circuit etc. of an air conditioning machine such as an air conditioner and a freezer.

Moreover, in the structure of the conventional centrifugal pump, the coil portion that is the motor stator cannot be detached.

Even if the casing and the piping, etc. of metallic are used for the fluid in which the resisting pressure and the air-tight are required, heating fixation such as welding, soldering and adhesion can not be applied.

Therefore, a high air-tight metal casing and the piping can not be used.

In addition, a bearing of the impeller comprises a bearings which is disposed on one side of the shaft of the impeller.

Therefore, it would be unstable and there are problems in durability and silence.

In addition, in such a conventional structural centrifugal pump, the bearing is in the fluid and the lubricant cannot be used.

As a result, the axial member and the impeller will be worn out and damaged by the rotation of the impeller, so that loose and eccentricity are caused in the impeller.

Therefore, it is difficult to maintain an expected pump performance.

The invention considers such a current state and is to provide a centrifugal pump, in which, heating fixation such as welding, soldering and adhesion can be applied, a high air-tight metal casing and the piping can be used, and it can be used for the fluid in which the resisting pressure and the air-tight are required.

Moreover, the invention is to provide a centrifugal pump, in which the bearing of the rotating blade member is a stable structure, and durability and silence are excellent.

Moreover, the invention is to provide a centrifugal pump, in which in non-lubrication condition in which the bearing is in the fluid, sliding ability is excellent, the axial member and the impeller will not be worn out and damaged by the rotation of the impeller so that loose and eccentricity are not caused in the impeller, and the desired pump performance can be retained.

Solution to Problem

The invention was invented to achieve the object and the purpose in the above-mentioned prior art, the centrifugal pump of the invention is a centrifugal pump comprising, a rotating blade member including an impeller and a rotor magnet disposed under the impeller, a metallic main body casing in which the rotating blade member is accommodated, a metallic suction side coupling member which is disposed as connected to the main body casing to introduce a fluid into the impeller, a metallic discharge side coupling member which is disposed as connected to the main body casing to exhaust the fluid by rotating of the impeller, a coil portion which is disposed as to be located in periphery of the rotor magnet and rotates the rotating blade member, and the main body casing comprising, an upper main body casing, a lower main body casing fixed to the upper main body casing, and a blade casing, in which an interior space formed by the upper main body casing and the lower main body casing is partitioned, and in which a fluid introducing passage is formed on the upper portion and a rotating accommodating space to accommodate the rotating blade member is formed on lower portion, wherein a joint portion of the upper main body casing, the lower main body casing, and the blade casing is fixed on the state of sealing, and a joint portion of the suction side coupling member and the main body casing and a joint portion of the discharge side coupling member and the main body casing are fixed on the state of sealing.

By composing like this, a joint portion between the upper main body casing which composes the metallic main body casing, the lower main body casing, and the blade casing can be fixed, for instance, by heating such as welding, soldering and adhesion. As a result, they can be fixed on the state of sealing.

Moreover, the joint portion of the metallic suction side coupling member and the main body casing and a joint portion of the discharge side coupling member and the main body casing can be fixed, for instance, by heating such as welding, soldering and adhesion.

As a result, they can be fixed on the state of sealing.

That is, it has a structure that a jointing method with the air-tight and maintenance strength such as welding and soldering can be applied to these connecting portions.

Thus, they can be fixed by heating such as welding, soldering and adhesion.

Consequently, a high air-tight metal casing and the piping can be used, and it can be used for the fluid in which the resisting pressure and the air-tight are required.

Moreover, it has the blade casing, in which an interior space formed by the upper main body casing and the lower main body casing is partitioned.

In addition, it has the blade casing, in which the fluid introducing passage is formed on the upper portion and in which a rotating accommodating space to accommodate the rotating blade member is formed on lower portion.

Therefore, the path of the fluid can be easily formed.

Moreover, the centrifugal pump of the invention is characterized in that the main body casing comprises a metallic press molded article and the suction side coupling member and the discharge side coupling member comprise the metal pipe.

Like this, the main body casing comprises a metallic press molded article and the suction side coupling member and the discharge side coupling member comprise the metal pipe.

As a result, a jointing method with the air-tight and maintenance strength such as welding and soldering can be applied to these connecting portions. Moreover, the cost can be reduced.

Moreover, the centrifugal pump of the invention is characterized in that the main body casing and the coil portion are detachably fixed by a detaching means.

By composing like this, the main body casing and the coil portion are detachably fixed by a detaching means.

As a result, before fixing the coil portion to the main body casing, for instance, heating fixation such as welding, soldering and adhesion and a processing which requires heating can be applied to the main body casing, so that working property is improved.

Moreover, because the main body casing and the coil portion are detachably fixed by the detaching means, the exchange when the coil portion is broken down can be facilitated.

In addition, draw direction and coupling direction of wire can be arbitrarily selected.

Moreover, the centrifugal pump of the invention comprising, an upper bearing member which is disposed on the upper main body casing and in which an upper part of an axial member of the rotating blade member is pivoted, and a lower bearing member which is disposed on the lower main body casing and in which a lower part of the axial member of the rotating blade member is pivoted, wherein a connecting passage, in which the fluid introducing passage and the rotating accommodating space are connected, is formed on the upper bearing member.

By composing like this, the axial member of the rotating blade member is pivoted by the upper bearing member and the lower bearing member.

Therefore, a bearing of the rotating blade member is a stable structure so that an excellent centrifugal pump in durability and silence can be provided.

That is, the rotation of the rotating blade member is stable, the noise when rotating is reduced.

Moreover, the vibration of the rotating blade member is reduced so that durability can be also improved.

In addition, the connecting passage, in which the fluid introducing passage and the rotating accommodating space are connected, is formed on the upper bearing member.

As a result, piping etc. is not needed separately and the passage can be easily formed.

Moreover, the centrifugal pump of the invention is characterized in that, the axial member of the rotating blade member is fixed on the upper bearing member and the lower bearing member, and the rotating blade member is composed such that the rotating blade member is rotated around the outer periphery of the axial member.

By composing like this, the axial member of the rotating blade member is fixed on the upper bearing member and the lower bearing member, and the rotating blade member is composed such that the rotating blade member is rotated around the outer periphery of the axial member.

Therefore, the rotation sliding area is increased between the rotating blade member and the outer periphery of the axial member, and the contact surface pressure is reduced.

As a result, the rotation of the rotating blade member is stable, the noise when rotating is reduced.

Moreover, the vibration of the rotating blade member is reduced so that durability can be also improved.

Moreover, the centrifugal pump of the invention is characterized in that the axial member is fixed on the rotating blade member, and the rotating blade member is composed such that the rotating blade member is rotated between the upper bearing member and the axial member and between the lower bearing member and the axial member.

By composing like this, the axial member is fixed on the rotating blade member, and the rotating blade member is composed such that the rotating blade member is rotated between the upper bearing member and the axial member and between the lower bearing member and the axial member.

As a result, the rotation of the rotating blade member is stable, the noise when rotating is reduced.

Moreover, the vibration of the rotating blade member is reduced so that durability can be also improved.

Moreover, the centrifugal pump of the invention is characterized in that a rotating part between the rotating blade member and the axial member comprises synthetic resin having a high slidability.

Moreover, the centrifugal pump of the invention is characterized in that a rotating part between the upper bearing member, the lower bearing member, and the axial member comprises synthetic resin having a high slidability.

Like this, the rotating part comprises synthetic resin having a high slidability, for instance, lubricant resin (PPS, PTFE) having chemical resistance.

As a result, the invention is to provide a centrifugal pump, in which in non-lubrication condition in which the bearing is in the fluid, sliding ability is excellent, the axial member and the impeller will not be worn out and damaged by the rotation of the impeller so that loose and eccentricity are not caused in the impeller, and the desired pump performance can be retained.

Advantageous Effects of Invention

According to the invention, a joint portion of the upper main body casing which composes the metallic main body casing, the lower main body casing, and the blade casing can be fixed, for instance, by heating such as welding, soldering and adhesion.

As a result, they can be fixed on the state of sealing.

Moreover, the joint portion of the metallic suction side coupling member and the main body casing and a joint portion of the discharge side coupling member and the main body casing can be fixed, for instance, by heating such as welding, soldering and adhesion.

As a result, they can be fixed on the state of sealing.

That is, it has a structure that a jointing method with the air-tight and maintenance strength such as welding and soldering can be applied to these connecting portions.

Thus, they can be fixed by heating such as welding, soldering and adhesion.

Consequently, a high air-tight metal casing and the piping can be used, and it can be used for the fluid in which the resisting pressure and the air-tight are required.

Moreover, it has the blade casing, in which an interior space formed by the upper main body casing and the lower main body casing is partitioned.

In addition, it has the blade casing, in which the fluid introducing passage is formed on the upper portion and in which a rotating accommodating space to accommodate the rotating blade member is formed on lower portion.

Therefore, the path of the fluid can be easily formed.

DESCRIPTION OF EMBODIMENTS

Figure 1:
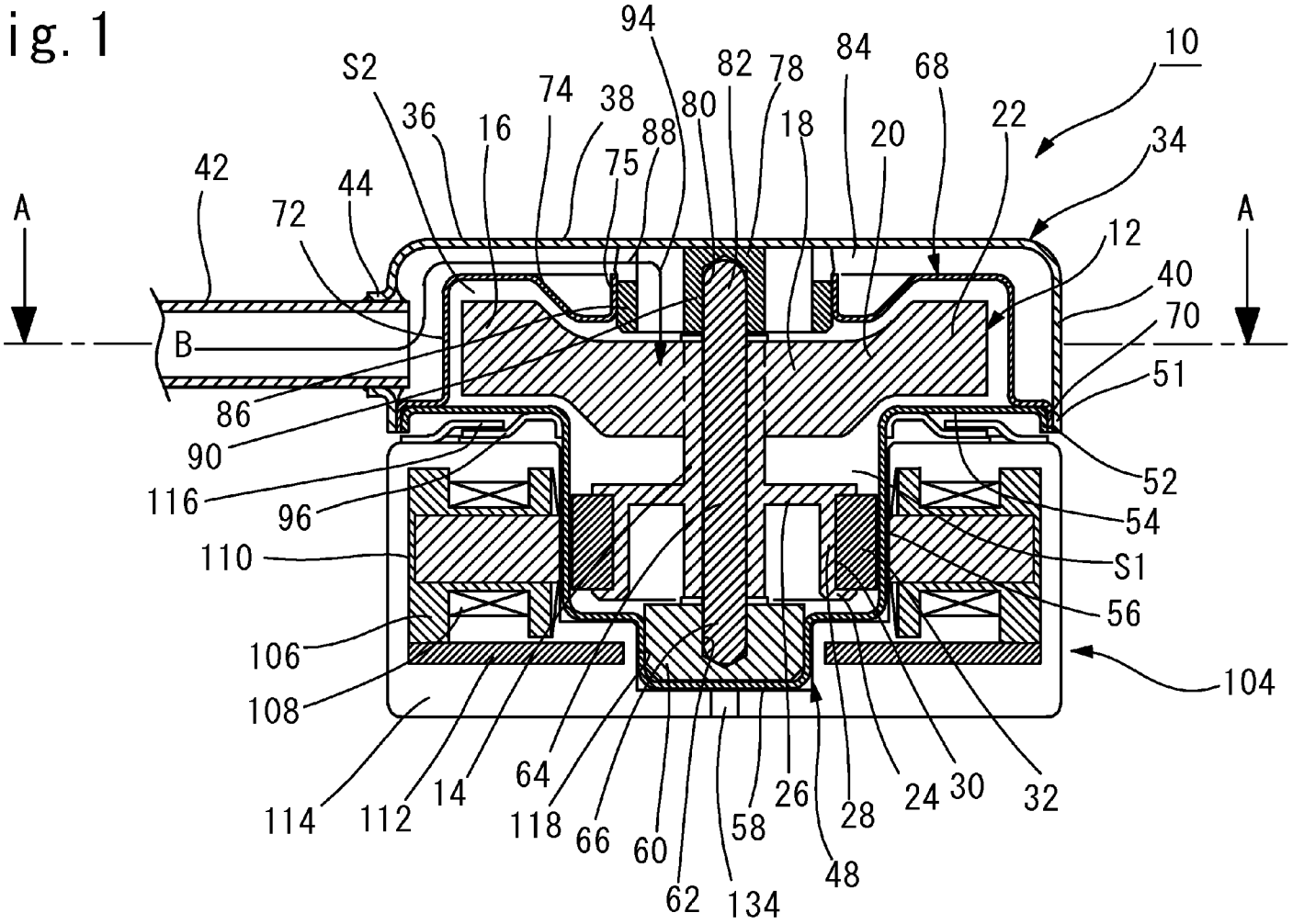
FIG. 1 is a longitudinal sectional view of the centrifugal pump of the invention.

Hereafter, the embodiment of the invention (Embodiment) is described in the detail or more on the basis of the drawing.

Embodiment 1

FIG. 1 is a longitudinal sectional view of the centrifugal pump of the invention.

Figure 2:
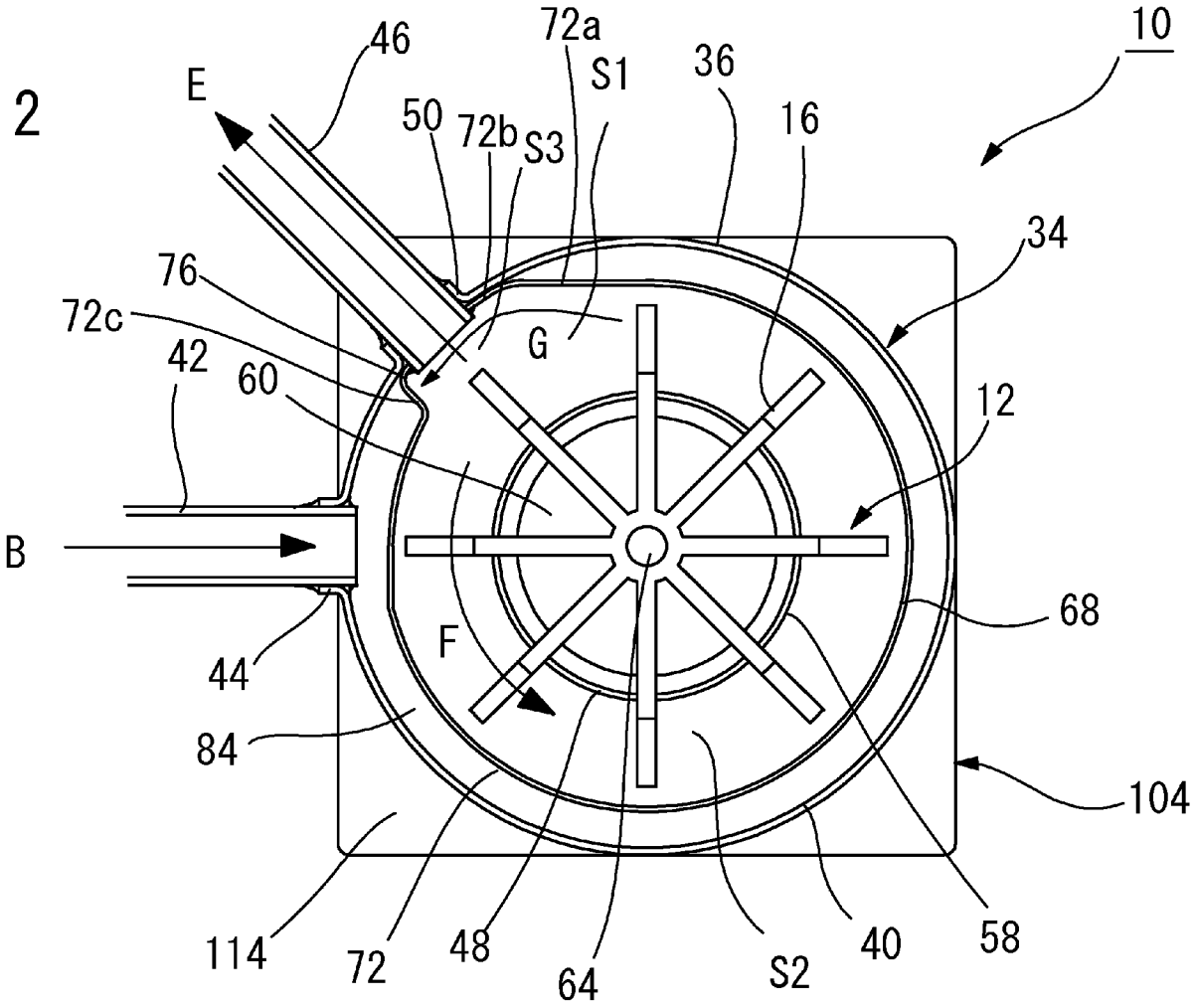
FIG. 2 is an auxiliary view in the A-A line of FIG. 1.

FIG. 2 is an auxiliary view in the A-A line of FIG. 1.

Figure 3:
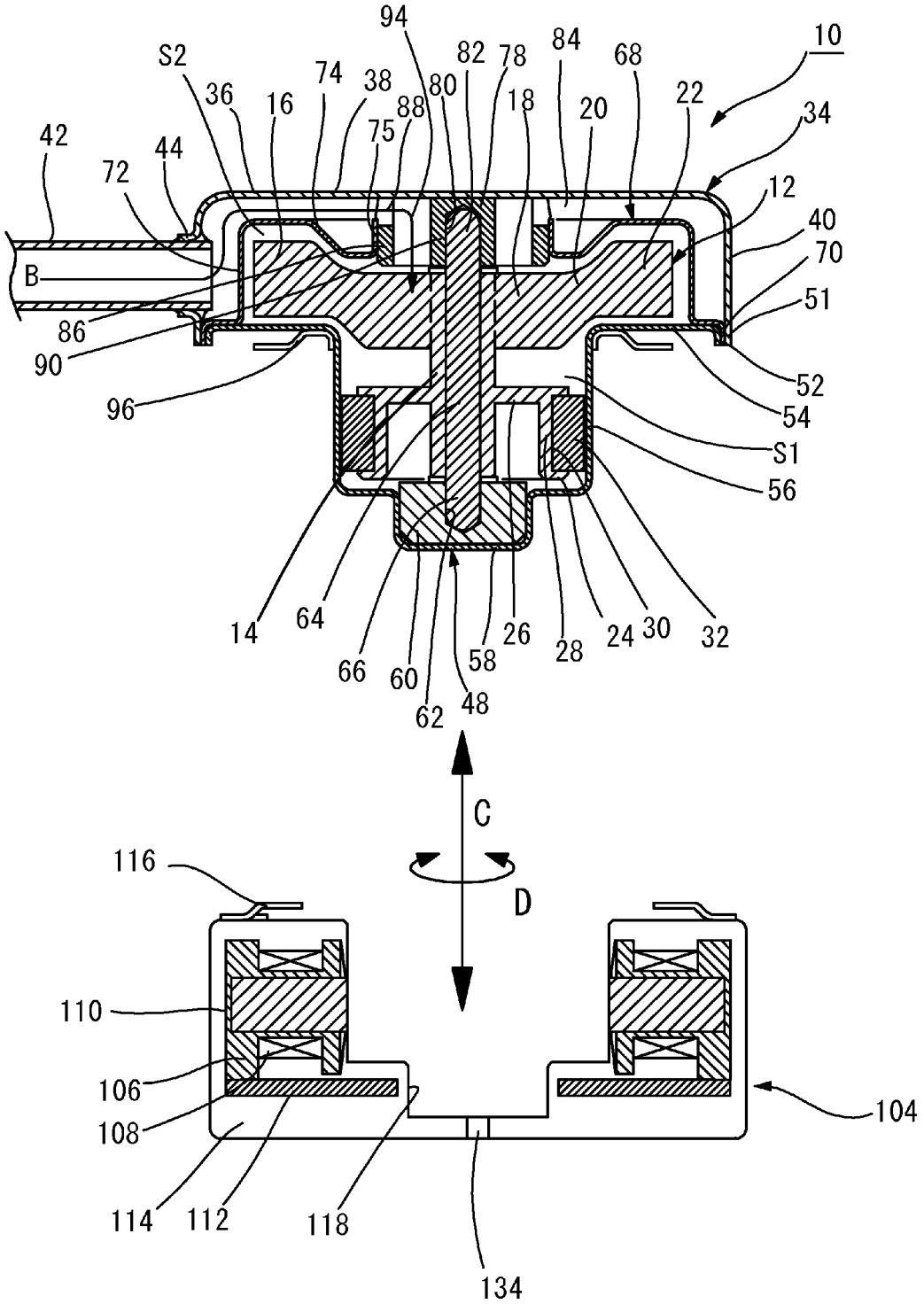
FIG. 3 is a longitudinal sectional view similar to FIG. 1 describing the state in which the coil portion is detached from the main body casing of the centrifugal pump of the invention.

FIG. 3 is a longitudinal sectional view similar to FIG. 1 describing the state in which the coil portion is detached from the main body casing of the centrifugal pump of the invention.

Figure 4:
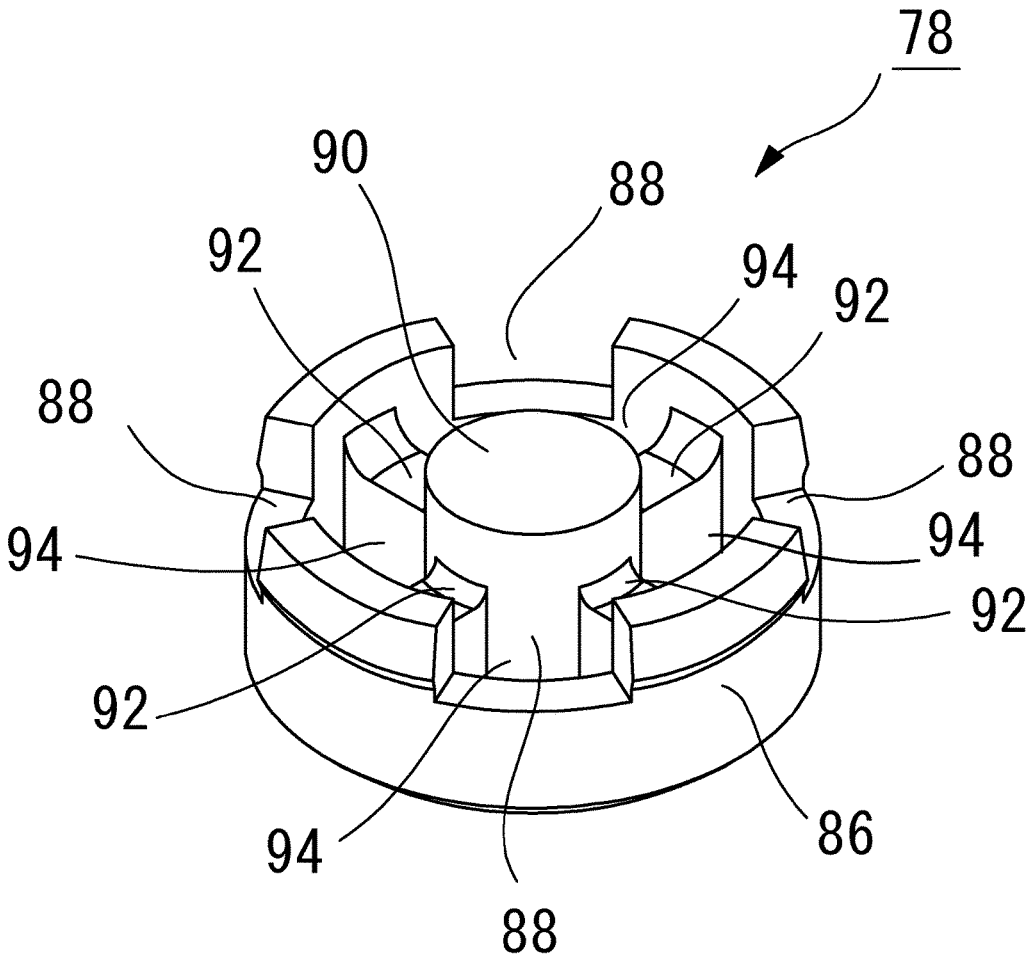
FIG. 4 is a perspective view seen from the top side of the upper bearing member of the centrifugal pump of the invention.

FIG. 4 is a perspective view seen from the top side of the upper bearing member of the centrifugal pump of the invention.

Figure 5:
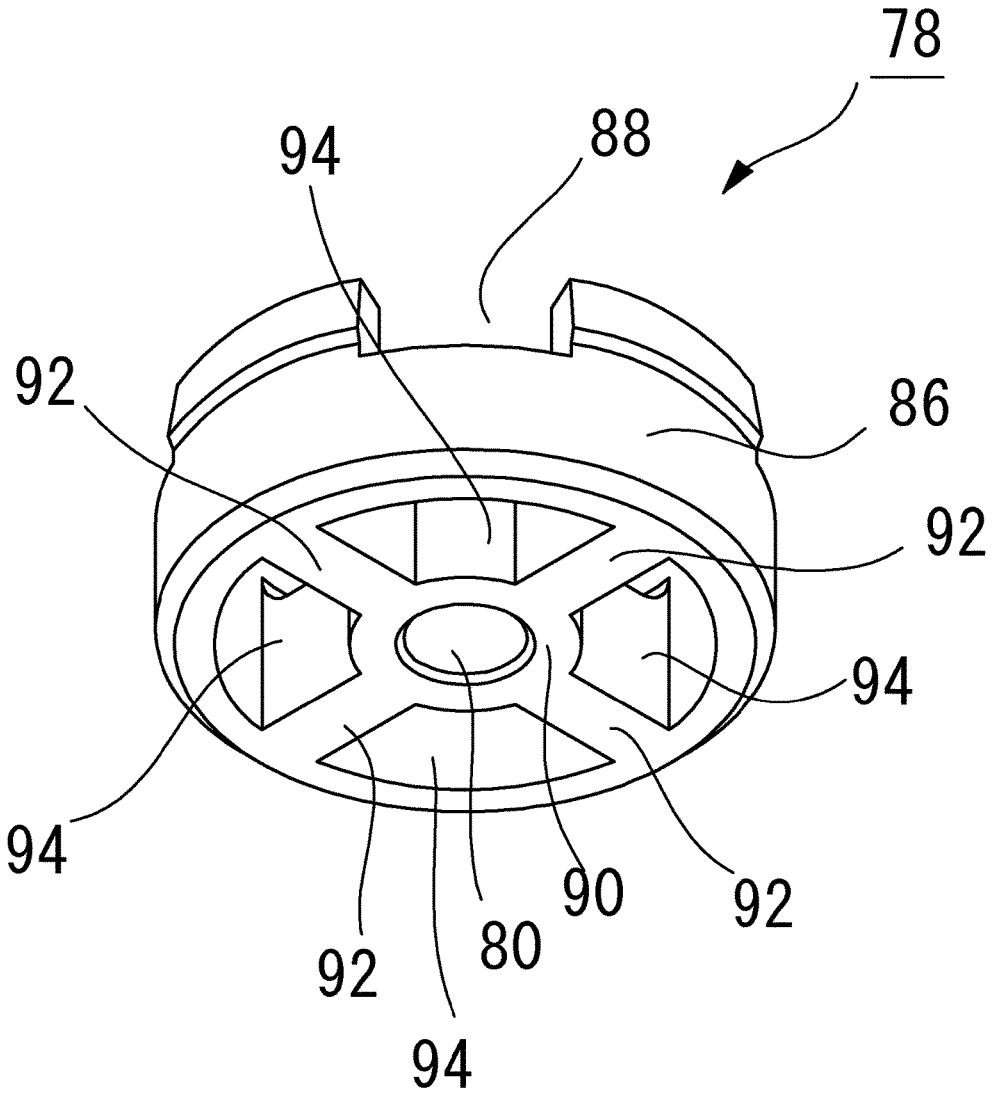
FIG. 5 is a perspective view seen from a lower side of the upper bearing member of the centrifugal pump of the invention.

FIG. 5 is a perspective view seen from a lower side of the upper bearing member of the centrifugal pump of the invention.

Figure 6:
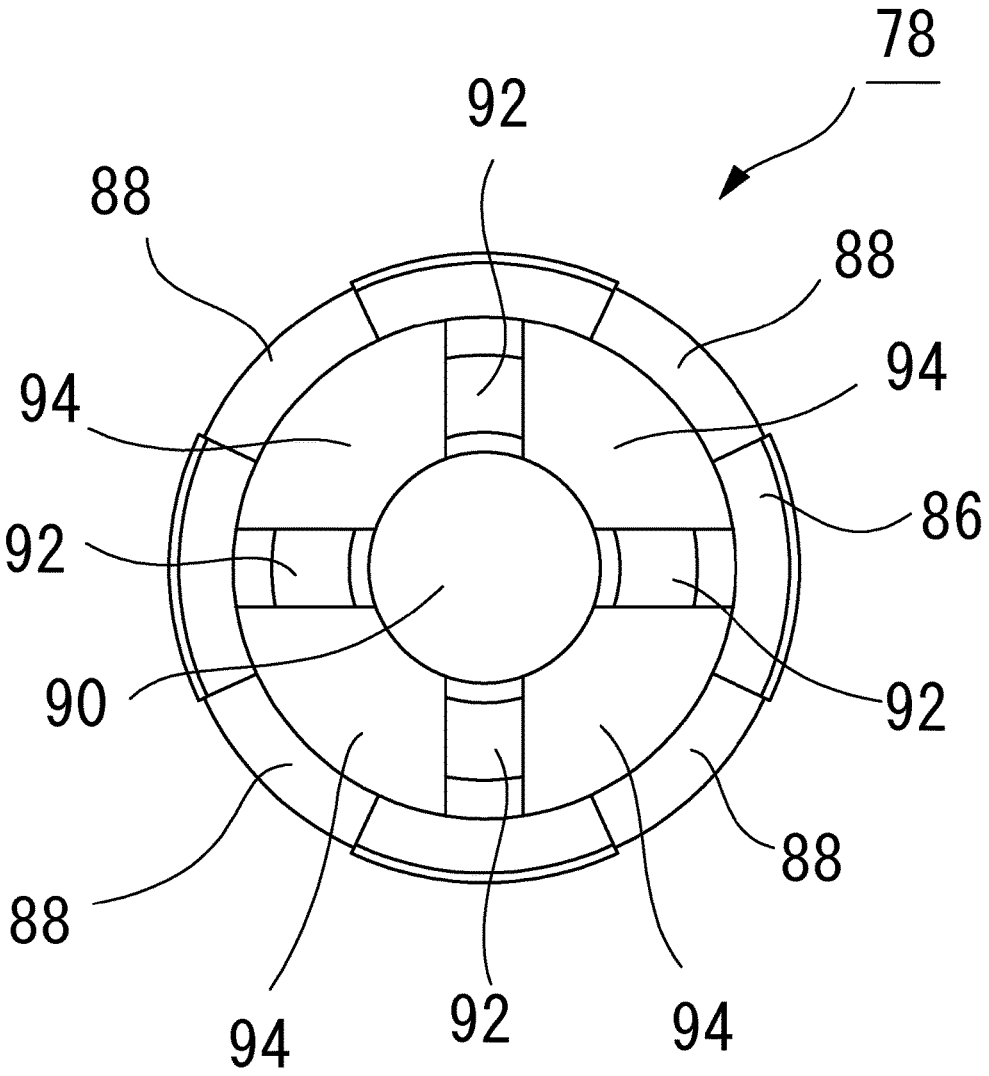
FIG. 6 is a top view of the upper bearing member of the centrifugal pump of the invention.

FIG. 6 is a top view of the upper bearing member of the centrifugal pump of the invention.

Figure 7:
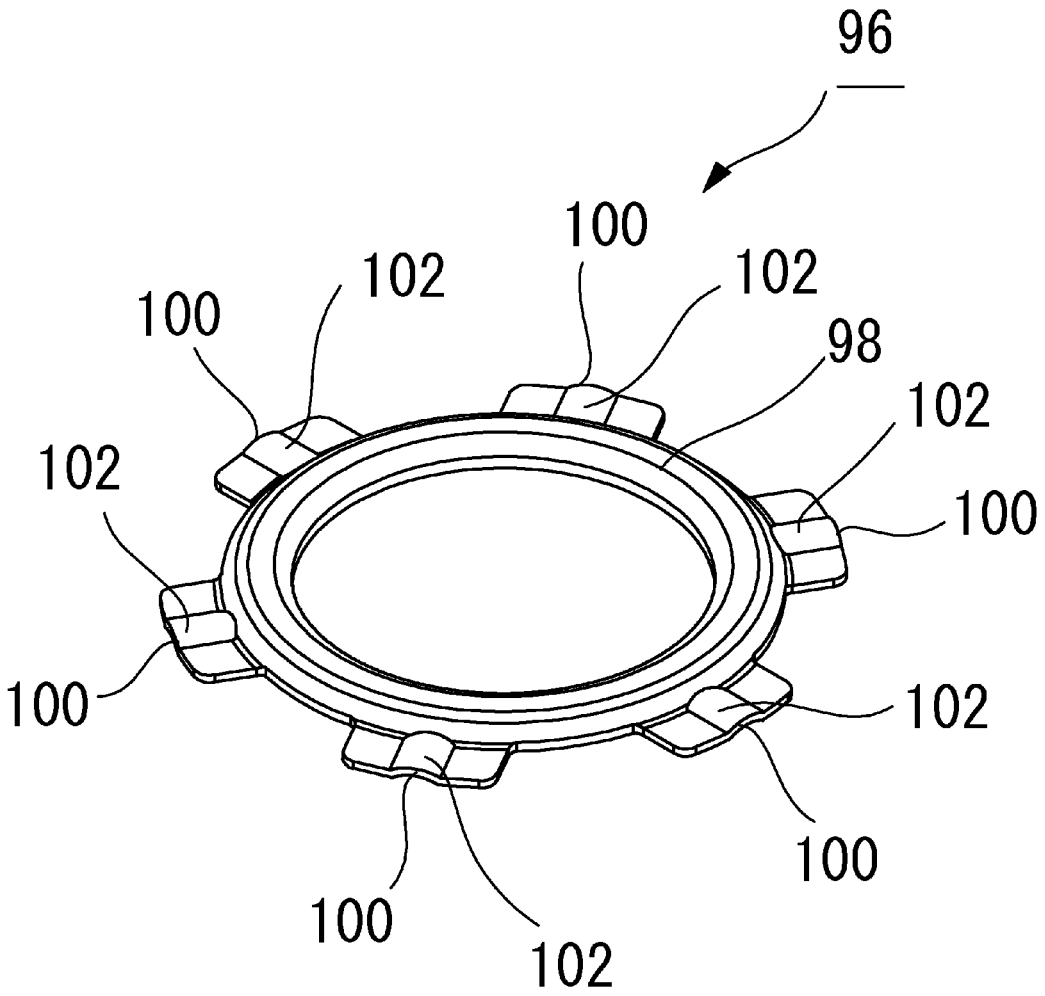
FIG. 7 is an upper perspective view of the main body side fixation metal fittings of the centrifugal pump of the invention.

FIG. 7 is an upper perspective view of the main body side fixation metal fittings of the centrifugal pump of the invention.

Figure 8:
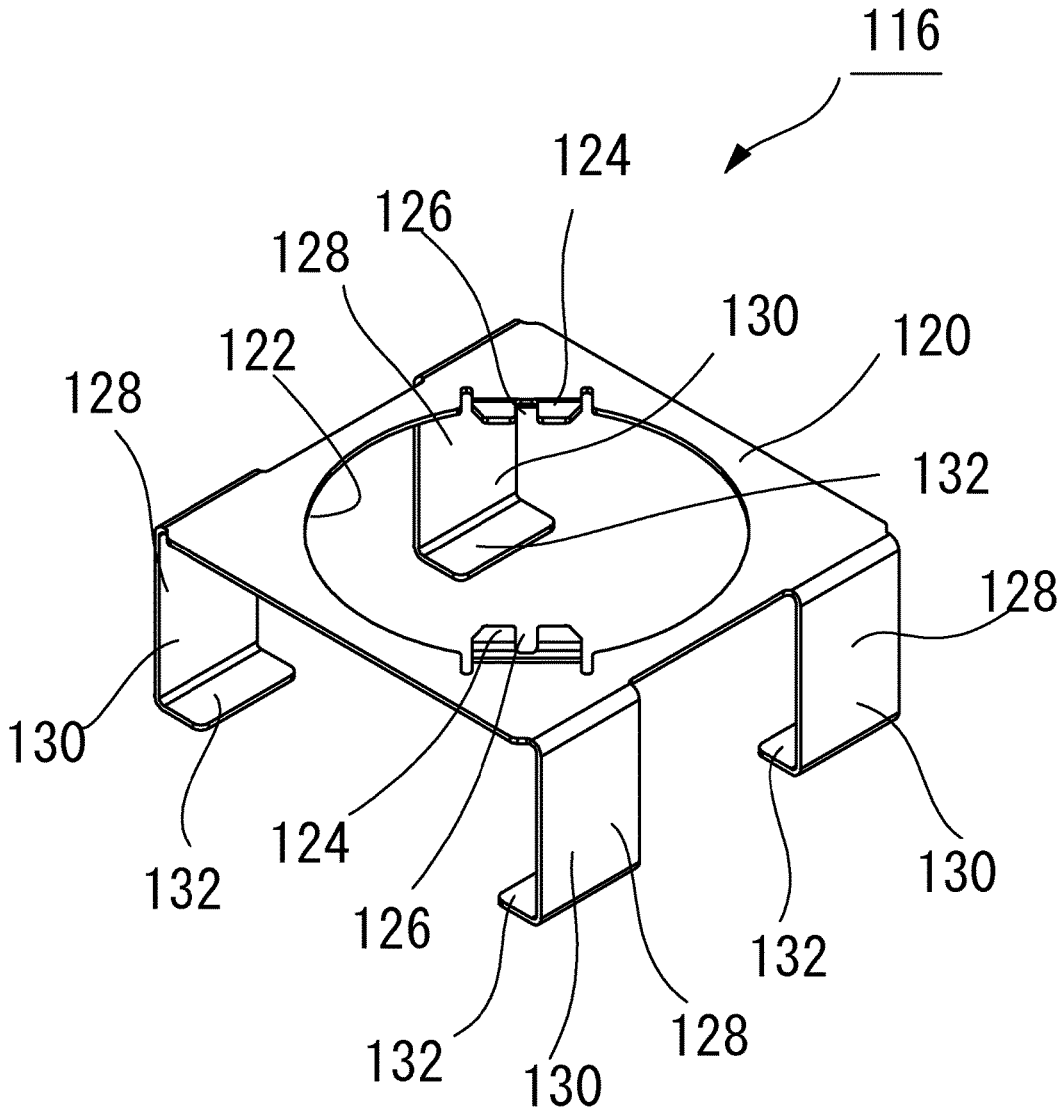
FIG. 8 is an upper perspective view of the coil side fixing bracket of the centrifugal pump of the invention.

FIG. 8 is an upper perspective view of the coil side fixing bracket of the centrifugal pump of the invention.

In FIG. 1-FIG. 3, the reference numeral 10 shows the centrifugal pump of the invention as a whole.

As shown in FIG. 1-FIG. 3, a centrifugal pump 10 of the invention comprises a rotating blade member 12.

As shown in FIG. 2, this rotating blade member 12 comprises a plurality of blade members 16 (8 in this Embodiment), which is radially extended in the direction of the outer periphery in the upper part of a circular tube bearing portion 14.

In addition, the number of sheets of this blade member 16 may be elected according to the usage of centrifugal pump 10 and the pump ability that is required, and is not limited especially.

As shown in FIG. 1, the blade member 16 is provided with a base edge 18 which is extended from the bearing portion 14 in the direction of the outer periphery, a bending portion 20 which is bended in the upper side from this base edge 18, and an outside blade portion 22 which is extended from this bending portion 20 in direction of outer periphery.

By forming the shape of the blade member 16 to such shape, the discharge ability can be improved by function of the outside blade portion 22 by rotating of the blade member 16.

Moreover, on the rotating blade member 12, a first rotor magnet accommodating portion 24, which is extended in the direction of the outer periphery, is formed under the bearing portion 14.

The first rotor magnet accommodating portion 24 is provided with a flange portion 26 which is extended from the lower side of the bearing portion 14 in direction of outer periphery, and a support portion 28 which is downwardly extended from the flange portion 26.

Moreover, in a recess 30 which comprises this flange portion 26 and the support portion 28, a rotor magnet 32, which comprises an annular permanent magnet, is fitted.

Furthermore, as shown in FIG. 1, the centrifugal pump 10 of the invention is provided with a metallic main body casing 34 in which the rotating blade member 12 is accommodated.

The main body casing 34 is provided with an upper main body casing 36.

The upper main body casing 36 comprises a top wall 38 and a side peripheral wall 40 which is downwardly extended from outer periphery of the top wall 38.

Moreover, as shown in FIG. 1 and FIG. 2, on the side peripheral wall 40 of the upper main body casing 36, a flange 44, in which an opening portion to fix a metallic suction side coupling member 42 is formed, is formed.

As shown in FIG. 2, on this flange 44, the suction side coupling member 42 is sealingly fixed by, for instance, such as welding, soldering and adhesion.

As a result, the suction side coupling member 42 is connected to the main body casing 34.

Moreover, as shown in FIG. 2, on the side peripheral wall 40 of the upper main body casing 36, a flange 50, in which an opening portion to fix a metallic discharge side coupling member 46 is formed, is formed.

The central angle degree of the opening of the flange 50 is shifted with that of an opening portion to fix the suction side coupling member 42 (in this Embodiment, the central angle degree is shifted 45 degree).

In addition, this shifting angle can not be especially limited, and can be changed by the design change according to the usage etc.

As shown in FIG. 2, on this flange 50, the discharge side coupling member 46 is sealingly fixed by, for instance, such as welding, soldering and adhesion.

As a result, the discharge side coupling member 46 is connected to the main body casing 34.

Moreover, as shown in FIG. 1 and FIG. 2, the main body casing 34 is provided with a lower main body casing 48.

Moreover, on an inner wall of a lower end 51 of the side peripheral wall 40 of the upper main body casing 36, an outer periphery flange 52 of the lower main body casing 48 is sealingly fixed by, for instance, such as welding, soldering and adhesion.

As a result, in the main body casing 34, an interior space S1, which is surrounded with the upper main body casing 36 and the lower main body casing 48, is formed.

As shown in Fig. As shown in FIG. 1, this lower main body casing 48 includes a blade accommodating portion 54 and a second rotor magnet accommodating portion 56. The blade accommodating portion 54 is horizontally extended from an outer periphery flange 52 of the lower main body casing 48 to an inner periphery side. The second rotor magnet accommodating portion 56 is extended downwardly from this blade accommodating portion 54.

In addition, under this second rotor magnet accommodating portion 56, a lower bearing member accommodating portion 58, which has a bottom and is cylindrical shape, is formed.

Moreover, in the lower bearing member accommodating portion 58, a lower bearing member 60 is fitted by, for instance, press fit etc.

In a shaft hole 62 formed on this lower bearing member 60, a lower end portion 66 of an axial member 64 is fixed as pivoted by, for instance, press fit etc.

Moreover, in the bearing portion 14 of this rotating blade member 12, the axial member 64 is passed through so that the rotating blade member 12 can be rotated around.

In addition, as shown in FIG. 1 and FIG. 2, the main body casing 34 is provided with a blade casing 68.

An outer periphery flange 70 of this blade casing 68 is sealingly fixed by, for instance, such as welding, soldering and adhesion, in the state that it is sandwiched between the lower end 51 of the upper main body casing 36 and the outer periphery flange 52 of the lower main body casing 48.

Moreover, the blade casing 68 is provided with a side peripheral wall 72, which is upwardly extended from the outer periphery flange 70, and a bending portion 74, which is downwardly bended as having a shape along the bending portion 20 of the blade member 16 from the side peripheral wall 72.

In addition, an inner periphery flange 75, which is upwardly extended from the bending portion 74, is formed.

By having such shape, between the blade accommodating portions 54 of the blade casing 68 and the lower main body casing 48, the blade member 16 can be accommodated.

Moreover, an upper bearing member 78 is fitted to an inner periphery flange 75 of the blade casing 68 by, for instance, press fit etc.

As a result, by the inner periphery flange 75 of blade casing 68, the upper bearing member 78 is stably supported so that eccentricity and the vibration by the rotation of the rotating blade member 12 can be prevented.

In a shaft hole 80 formed on this upper bearing member 78, a top portion 82 of the axial member 64, which is passed through in the bearing portion 14 of the rotating blade member 12, is fixed as pivoted by, for instance, press fit etc.

Moreover, as shown in FIG. 1 and FIG. 2, the diameter of the side peripheral wall 72 of the blade casing 68 is formed smaller than the diameter of the side peripheral wall 40 of the upper main body casing 36.

In addition, the height of the side peripheral wall 72 of the blade casing 68 is formed smaller than the height of the side peripheral wall 40 of the upper main body casing 36.

As a result, by the blade casing 68, the interior space S1, which is formed by the upper main body casing 36 and the lower main body casing 48, is partitioned.

Consequently, a fluid introducing passage 84 is formed on the upper part.

Moreover, a rotating accommodating space S2, in which the rotating blade member 12 is accommodated, is formed on the lower part.

Moreover, as shown in FIG. 2, on a part of the side peripheral wall 72 of the blade casing 68, a flange 76, in which an opening portion to fix the discharge side coupling member 46 is formed, is formed.

In addition, the discharge side coupling member 46 is sealingly fixed by, for instance, such as welding, soldering and adhesion, together with a flange 50 of the side peripheral wall 40 of the upper main body casing 36.

As a result, the discharge side coupling member 46 is connected to the rotating accommodating space S2 of the main body casing 34.

In addition, in the direction (counterclockwise in FIG. 2) indicated in arrow F of FIG. 2, the blade member 16 of the rotating blade member 12 is rotated.

In this case, as shown in FIG. 2, in the flange 76, which is a fixing portion with the discharge side coupling member 46 of the side peripheral wall 72 of the blade casing 68, on the upstream side of the rotating direction of the blade member 16, an enlarged diameter portion 72*a*, which is gradually enlarged in diameter direction, is provided.

Moreover, the connecting part of this enlarged diameter portion 72*a* and the flange 76 composes a guide portion 72*b*, which is in the state that it is inscribed to the side peripheral wall 40 of the upper main body casing 36.

On the other hand, as shown in FIG. 2, in the flange 76, which is a fixing portion with the discharge side coupling member 46 of the side peripheral wall 72 of the blade casing 68, on the downstream side of the rotating direction of the blade member 16, a flow control sidewall portion 72*c*, which is radially extended.

By composing like this, as shown in FIG. 2, a flow control space S3, which is surrounded by the enlarged diameter portion 72*a*, the guide portion 72*b*, and the flow control sidewall portion 72*c* and in which the fluid is accumulated, is formed.

Moreover, by rotating of the blade member 16 of the rotating blade member 12, as showed by arrow G, the fluid is guided from the enlarged diameter portion 72*a* to the guide portion 72*b*.

As a result, the fluid is abutted (i.e. pressed) to the flow control sidewall portion 72*c*.

Consequently, the fluid pressure of the inside of the blade casing 68 is risen, and there is an effect that flowing quantity is increased.

On the other hand, as shown in FIG. 4-FIG. 6, the upper bearing member 78 is substantially crown shape and a plurality of notch portions 88 is formed on the upper part of a sidewall 86.

That is, in this Embodiment, four notch portions 88, which are formed mutually spaced by 90 degrees of the central angle degree, are formed.

Moreover, on the center section of the upper bearing member 78, a central axis receiving portion 90, in which the shaft hole 80 is formed on the lower part, is provided.

It is connected with a plurality of ribs 92 between this central axis receiving portion 90 and the sidewall 86.

That is, in this Embodiment, it is connected with four ribs 92, which are formed mutually spaced by 90 degrees of the central angle degree corresponding to four notch portions 88.

By composing like this, as shown in FIG. 5 and FIG. 6, a vertical passage 94, which is penetrated in four axial direction, is formed.

Consequently, as shown by arrow B of FIG. 1, the fluid sucked from the suction side coupling member 42 is passed from the fluid introducing passage 84, which is formed by the blade casing 68 and the upper main body casing 36, to the notch portion 88 of the sidewall 86 of the upper bearing member 78.

Moreover, the fluid passed through the notch portion 88 is introduced into the rotating accommodating space S2, which is formed by the blade casing 68 and the lower main body casing 48, through the vertical passage 94.

In addition, as shown in FIG. 1 and FIG. 7, on the outer periphery of the second rotor magnet accommodating portion 56 of the lower main body casing 48, a metallic main body casing side fixing bracket 96, which composes detaching means, is fixed, for instance, by heating such as welding, soldering, adhesion and press fit, etc.

As shown in FIG. 7, this main body casing side fixing bracket 96 is provided with a fixing bracket main body 98 having a ring shape, and a plurality of engaging pieces 100, which are extended from the fixing bracket main body 98 in direction of outer periphery, and are formed mutually spaced at fixed space.

Moreover, an engaging portion 102 is formed on the center section of an engaging piece 100 as protruded upwardly.

In this Embodiment, as shown in FIG. 7, six engaging pieces 100 are provided as spaced mutually by 60 degrees of the central angle degree.

Moreover, as shown in FIG. 1 and FIG. 3, the centrifugal pump 10 of the invention is provided with a coil portion 104, which is to be located in the periphery of rotor magnet 32, and which is disposed on the outer periphery of the second rotor magnet accommodating portion 56 of the lower main body casing 48, and which rotates the rotating blade member 12.

The coil portion 104 is provided with a plurality of coils 110, which comprises a winding wire 108 rolled in a bobbin casing 106.

In addition, on an electronic substrate 112 for performing electronic control, the coil portion 104 is disposed in the direction of a circumference at the fixed interval (not shown).

Moreover, these coils 110 are molded with the molding resin, so that a molding resin portion 114 is formed.

As a result, it is integrated, and the coil portion 104 is formed.

In addition, though not shown in the drawing, the coil portion 104 molded with the molding resin, as described later, in order to easily fix a coil side fixing bracket 116 on the coil portion 104, is a square pole shape.

Moreover, as shown in FIG. 1, in the coil portion 104, on the center section thereof, an accommodating recess 118, in which the second rotor magnet accommodating portion 56 of the lower main body casing 48 and the lower bearing member accommodating portion 58 is accommodated, is formed.

In addition, as shown in FIG. 1 and FIG. 8, the coil portion 104 is provided with the coil side fixing bracket 116 which composes the detaching means.

As shown in FIG. 8, the coil side fixing bracket 116 is provided with a coil side fixing bracket main body 120 having flat plate shape.

On the center thereof, an opening portion 122, which is corresponding to the accommodating recess 118 of the coil portion 104, is formed.

Moreover, on the inner periphery edge of the opening portion 122, two engaging pieces 124, which are disposed oppositely to each other, is formed to be protruded above the inner periphery side.

On the tip of this engaging piece 124, an engaging notch portion 126 is formed.

As described later, it is composed that the engaging portion 102 of the main body casing side fixing bracket 96 is engaged with the engaging notch portion 126 of the coil side fixing bracket 116.

In addition, on four corner portions of the coil side fixing bracket main body 120, a fixing piece 128 having substantially L shape section is respectively formed.

The fixing piece 128 is provided with a fixing piece main body 130, and an engaging piece 132, which is formed by bending toward inside on the tip of the fixing piece main body 130.

In the coil side fixing bracket 116 composed like this, under the condition that the fixing piece main body 130 is expanded, it is installed to the coil portion 104.

Thereafter, the fixing piece main body 130 is narrowed, and is engaged by the engaging piece 132, so that it can be fixed to the coil portion 104.

As for the method in which the coil portion 104 composed like this is detachably provided under the main body casing 34, the following method can be adopted.

That is, as shown by arrow C of FIG. 3, in the accommodating recess 118 which is formed on the center section of the coil portion 104, the second rotor magnet accommodating portion 56 of the lower main body casing 48 and the lower bearing member accommodating portion 58 are accommodated.

Under such a condition, as shown by arrow D of FIG. 3, at least one of the coil portion 104 and the main body casing 34 is rotated.

As a result, the engaging piece 124 of the coil side fixing bracket 116 and the engaging piece 100 of main body casing side fixing bracket 96 are engaged.

In addition, the engaging portion 102 of the main body casing side fixing bracket 96 is elastically deformed.

Consequently, it is engaged and fixed to the engaging notch portion 126 of the coil side fixing bracket 116 with so-called snap fit type engaging.

Moreover, in order to detach the coil portion 104 from the main body casing 34, a reverse operation is performed, so that, as shown by arrow D of FIG. 3, at least one of the coil portion 104 and the main body casing 34 is rotated.

As a result, the engaging of the snap fit type between the engaging portion 102 of the main body casing side fixing bracket 96 and the engaging notch portion 126 of the coil side fixing bracket 116 is released.

Consequently, as shown by arrow C of FIG. 3, the coil portion 104 can be detached from the lower side of the main body casing 34.

In addition, in FIG. 1 and FIG. 3, the reference numeral 134 shows the drain hole 104, which is formed on the coil portion.

The centrifugal pump 10 of the invention composed like this is operated as follows.

First of all, the electric current is flowed through the coil 110 of the coil portion 104, so that the coil 110 is excited.

As a result, it affects on the rotor magnet 32 of the rotating blade member 12.

Consequently, the rotating blade member 12 can be rotated around the axial member 64, which is passed through the bearing portion 14.

As a result, the blade member 16 of the rotating blade member 12 is rotated.

Consequently, as shown by arrow B of FIG. 1, the fluid sucked from the suction side coupling member 42 is passed from the fluid introducing passage 84, which is formed by the blade casing 68 and the upper main body casing 36, to the notch portion 88 of the sidewall 86 of the upper bearing member 78.

Moreover, the fluid passed through the notch portion 88 is introduced into the rotating accommodating space S2, which is formed by the blade casing 68 and the lower main body casing 48, through the vertical passage 94 of the upper bearing member 78.

Moreover, by the turning force of the blade member 16 of the rotating blade member 12, as shown by arrow E of FIG. 2, the fluid introduced into the rotating accommodating space S2 is discharged through the discharge side coupling member 46 from the rotating accommodating space S2 of the main body casing 34.

According to the centrifugal pump 10 of the invention composed like this, the joint portion between the upper main body casing 36 which composes the metallic main body casing 34, the lower main body casing 48, and the blade casing 68, can be fixed, for instance, by heating such as welding, soldering and adhesion.

As a result, they can be fixed on the state of sealing.

Moreover, the joint portion between the metallic suction side coupling member 42 and the main body casing 34, and the joint portion between the discharge side coupling member 46 and the main body casing 34 can be fixed, for instance, by heating such as welding, soldering and adhesion.

As a result, they can be fixed on the state of sealing.

That is, it has a structure that a jointing method with the air-tight and maintenance strength such as welding and soldering can be applied to these connecting portions.

Thus, they can be fixed by heating such as welding, soldering and adhesion.

Consequently, a high air-tight metal casing and the piping can be used, and it can be used for the fluid in which the resisting pressure and the air-tight are required.

Moreover, it has the blade casing 68, in which the interior space S1 formed by the upper main body casing 36 and the lower main body casing 48 is partitioned.

In addition, it has the blade casing 68, in which the fluid introducing passage 84 is formed on the upper portion and in which the rotating accommodating space S2 to accommodate the rotating blade member 12 is formed on lower portion.

Therefore, the path of the fluid can be easily formed.

In this case, it is preferable that the main body casing 34 comprises a metallic press molded article, and the suction side coupling member 42 and the discharge side coupling member 46 comprise the metal pipe.

As a result, a jointing method with the air-tight and maintenance strength such as welding and soldering can be applied to these connecting portions. Moreover, the cost can be reduced.

Moreover, the main body casing 34 and the coil portion 104 are detachably fixed by a detaching means.

Namely, in this Embodiment, they are fixed detachably by the main body casing side fixing bracket 96 and the coil side fixing bracket 116.

As a result, before fixing the coil portion 104 to the main body casing 34, for instance, heating fixation such as welding, soldering and adhesion and a processing which requires heating can be applied to the main body casing 34, so that working property is improved.

Moreover, because the main body casing 34 and the coil portion 104 are detachably fixed by the detaching means, the exchange when the coil portion 104 is broken down can be facilitated.

In addition, draw direction and coupling direction of wire (i.e. the suction side coupling member 42 and the discharge side coupling member 46) can be arbitrarily selected.

In this case, in this Embodiment, as for the detaching means, engaging between the main body casing side fixing bracket 96 and the coil side fixing bracket 116 is adopted.

That is, it comprises engaging between the engaging piece 124 of the coil side fixing bracket 116 and the engaging piece 100 of the main body casing side fixing bracket 96, and engaging between the engaging portion 102 of the main body casing side fixing bracket 96 and the engaging notch portion 126 of the coil side fixing bracket 116.

However, it is not limited in any way, and as for detaching means, for instance, other detaching means such as engaging by the screw engaging and by the convex or concave can be adopted.

In addition, the axial member 64 of the rotating blade member 12 is pivoted by the upper bearing member 78 and the lower bearing member 60.

Therefore, the bearing of the rotating blade member 12 is a stable structure so that an excellent centrifugal pump 10 in durability and silence can be provided.

That is, the rotation of the rotating blade member 12 is stable, the noise when rotating is reduced.

Moreover, the vibration of the rotating blade member 12 is reduced so that durability can be also improved.

In addition, the connecting passage (i.e. the notch portion 88 and the vertical passage 94), in which the fluid introducing passage 84 and the rotating accommodating space S2 are connected, is formed on the upper bearing member 78.

As a result, piping etc. is not needed separately and the passage can be easily formed.

Moreover, the axial member 64 of the rotating blade member 12 is fixed on the upper bearing member 78 and the lower bearing member 60, and the rotating blade member 12 is rotated around the outer periphery of the axial member 64.

Therefore, the rotation sliding area is increased between the rotating blade member 12 and the outer periphery of the axial member 64, and the contact surface pressure is reduced.

As a result, the rotation of the rotating blade member is stable, the noise when rotating is reduced.

Moreover, the vibration of the rotating blade member is reduced so that durability can be also improved.

In this case, the rotating part between the rotating blade member 12 and the axial member 64 (i.e. at least the inner periphery of the bearing portion 14 of the rotating blade member 12 and the outer periphery of the axial member 64) comprises synthetic resin having a high slidability.

Thus, the bearing portion 14 and the axial member 64 of rotating blade member 12 comprise synthetic resin having a high slidability.

Moreover, only the inner periphery of the bearing portion 14 of rotating blade member 12 and the surface of the outer periphery of the axial member 64 can be covered by synthetic resin having such a slidability.

In this case, as for a synthetic resin having a high slidability, it is not especially limited.

For instance, lubricant resins having chemical resistance such as PPS and PTFE can be used.

Like this, the synthetic resin having a high slidability is used to the rotating part.

As a result, in non-lubrication condition in which the bearing is in the fluid, sliding ability is excellent, the axial member 64 and the rotating blade member 12 will not be worn out and damaged by the rotation of the rotating blade member 12, so that loose and eccentricity are not caused in the rotating blade member 12, and the desired pump performance can be retained.

In this case, though not shown, it is possible to compose so that the axial member 64 is fixed to the rotating blade member 12, and the rotating blade member 12 may rotate between the upper bearing member 78 and the axial member 64 and between the lower bearing member 60 and the axial member 64.

By composing like this, the rotation of the rotating blade member 12 is stable, the noise when rotating is reduced.

Moreover, the vibration of the rotating blade member 12 is reduced so that durability can be also improved.

In addition, in this case similarly, the synthetic resin having a high slidability can be used to the rotating part between the upper bearing member 78 and axial member 64 and between the lower bearing member 60 and the axial member 64.

Embodiment 2

Figure 9:
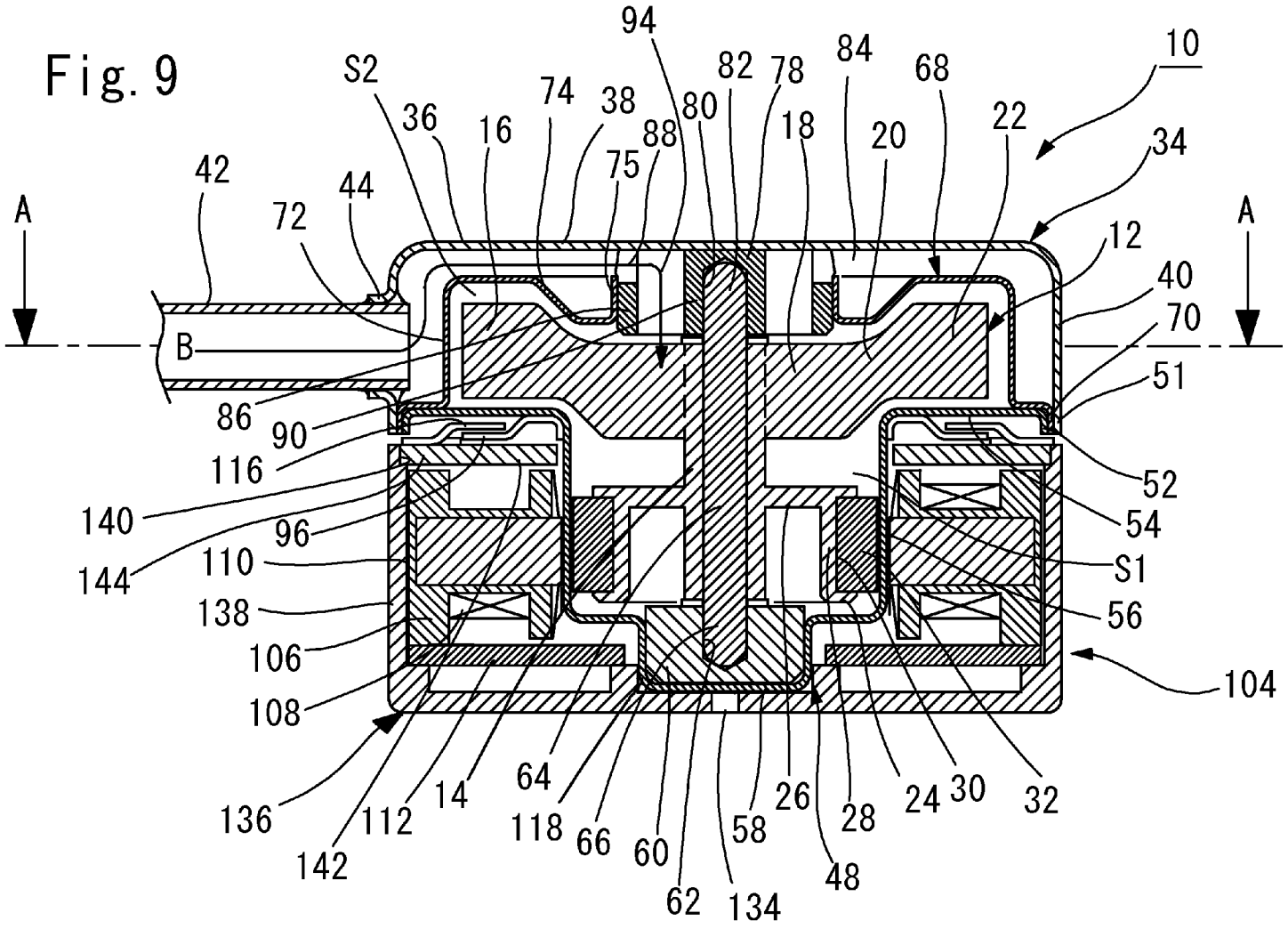
FIG. 9 is a longitudinal sectional view that shows another Embodiment of the centrifugal pump of the invention.

FIG. 9 is a longitudinal sectional view that shows another Embodiment of the centrifugal pump of the invention.

The centrifugal pump 10 of this Embodiment is basically similar composition of the centrifugal pump 10 shown in Embodiment 1 shown in FIG. 1-FIG. 8.

Like reference numeral is refer to the same composition member, and the detailed explanation is omitted.

In the centrifugal pump 10 of the Embodiment 1, the coil 110 is molded with the molding resin, so that the molding resin portion 114 is formed.

As a result, it is integrated, and the coil portion 104 is formed.

On the other hand, in the centrifugal pump 10 of this Embodiment, as shown in FIG. 9, the coil 110 is disposed in a coil casing 136 having bottom cylinder shape.

Moreover, it is fixed by fitting an outer periphery 144 of a cover member 142 to a steps portion 140 formed on the top of a sidewall 138 of the coil casing 136.

In addition, the portion between the steps portion 140 and the cover member 142 of this coil casing 136, if required, is fixed, for instance, by heating such as welding, soldering, adhesion and press fit, etc.

By composing like this, the molding resin is omitted and cost can be reduced and lightening can be attempted.

Although preferable embodiment of the invention is described above, the invention is not limited to this embodiment.

For instance, in the Embodiment, as shown in FIG. 8, the fixing piece main body 130 is narrowed, and is engaged by the engaging piece 132, so that the coil side fixing bracket 116 is fixed to the coil portion 104.

However, though not shown, the coil side fixing bracket 116 is integrated with the molding resin, so that it can be fixed to the coil portion 104.

In addition, in the Embodiment, the number of the suction side coupling member 42 and the discharge side coupling member 46 is assumed to be 1 piece respectively.

However, the number of suction side coupling member 42 and discharge side coupling member 46 can be plurality.

Therefore, various changes are possible in the scope in which it does not deviate from the object of the invention.

INDUSTRIAL APPLICABILITY

The invention can be applied to a centrifugal pump to supply a fluid, which is a cooling water of various machines such as a personal computer, a computer server, and a printer, and a cooling water such as internal combustion engine, and a refrigerant used for a refrigerant circulation circuit etc. of an air conditioning machine such as an air conditioner and a freezer.

EXPLANATION OF LETTERS OR NUMERALS

10 Centrifugal pump
12 Rotating blade member
14 Bearing portion
16 Blade member
18 Base edge.
20 Bending portion
22 Outside blade portion
24 First rotor magnet accommodating portion
26 Flange portion
28 Support portion
30 Recess
32 Rotor magnet
34 Main body casing
36 Upper main body casing
38 Top wall
40 Side peripheral wall
42 Suction side coupling member
44 Flange
46 Discharge side coupling member
48 Lower main body casing
50 Flange
51 Lower end
52 Outer periphery flange
54 Blade accommodating portion
56 Second rotor magnet accommodating portion
58 Lower bearing member accommodating portion
60 Lower bearing member
62 Shaft hole

64 Axial member
66 Lower end portion
68 Blade casing
70 Outer periphery flange
72 Side peripheral wall
72*a* Enlarged diameter portion
72*b* Guide portion
72*c* Flow control sidewall portion
74 Bending portion
75 Inner periphery flange
76 Flange
78 Upper bearing member
80 Shaft hole
82 The top portion
84 Fluid introducing passage
86 Sidewall
88 Notch portion
90 Central axis receiving portion
92 Rib
94 Vertical passage
96 Main body casing side fixing bracket
98 Fixing bracket main body
100 Engaging piece
102 Engaging portion
104 Coil portion
106 Bobbin case
108 Winding wire
110 Coil
112 Electronic substrate
114 Molding resin portion
116 Coil side fixing bracket
118 Accommodating recess
120 Coil side fixing bracket main body
122 Opening portion
124 Engaging piece
126 Engaging notch portion
128 Fixing piece
130 Fixing piece main body
132 Engaging piece
134 Drain hole
136 Coil casing
138 Sidewall
140 Steps portion
142 Cover member
144 Outer periphery
S1 Interior space
S2 Rotating accommodating space
S3 Flow control space

What is claimed is:

1. A centrifugal pump comprising, a rotating blade member including an impeller and a rotor magnet disposed under the impeller, a metallic main body casing in which the rotating blade member is accommodated, a metallic suction side coupling member which is connected to the metallic main body casing to introduce a fluid to the impeller, a metallic discharge side coupling member which is connected to the metallic main body casing to exhaust the fluid by rotation of the impeller, a coil portion which is located in a periphery of the rotor magnet and rotates the rotating blade member, a main body side fixing bracket associated with the metallic main body casing;

a coil side fixing bracket associated with the coil portion, and wherein the metallic main body casing and the coil portion are fixed and detached by rotating at least one of the main body side fixing bracket or the coil side fixing bracket, wherein the metallic main body casing includes:

an upper main body casing, a lower main body casing fixed to the upper main body casing, wherein the lower main body casing includes a cylindrical part having a bottom surface that closes an end of the cylindrical part, and a blade casing, which partitions an interior space, which is formed by the upper main body casing and the lower main body casing, into an upper interior space and a lower interior space, wherein the upper interior space is surrounded by the upper main body casing and the blade casing, wherein a fluid introducing passage is formed in the upper interior space, and a rotating accommodating space to accommodate the rotating blade member is formed in the lower interior space, wherein the fluid introducing passage is connected to the metallic suction side coupling member, and the rotating accommodating space is connected to the metallic discharge side coupling member, wherein the metallic suction side coupling member is fixed to an opening portion of a side peripheral wall of the upper main body casing, wherein the metallic discharge side coupling member is fixed to another opening portion of the side peripheral wall of the upper main body casing and a side peripheral wall of the blade casing, wherein a joint portion of the upper main body casing, the lower main body casing, and the blade casing are fixed and sealed by a first heating process, and wherein a joint portion of the metallic suction side coupling member and the metallic main body casing and a joint portion of the metallic discharge side coupling member and the metallic main body casing are fixed and sealed by a second heating process.

2. The centrifugal pump of claim 1 wherein the metallic main body casing comprises a metallic press molded article and the metallic suction side coupling member comprises a first metal pipe and the metallic discharge side coupling member comprises a second metal pipe.

3. The centrifugal pump of claim 1, wherein the first heating process is welding, soldering, or adhesion.

4. The centrifugal pump of claim 1, wherein the second heating process is welding, soldering, or adhesion.

5. The centrifugal pump of claim 1, wherein the lower main body casing includes:

a rotor magnet accommodating portion which extends downwardly from a blade accommodating portion, and a lower bearing member accommodating portion, which has a cylindrical part having a bottom surface that closes an end of the cylindrical part, under the rotor magnet accommodating portion, wherein a lower bearing member is disposed in the lower bearing member accommodating portion, and the rotor magnet is disposed in the rotor magnet accommodating portion.

6. The centrifugal pump of claim 1, wherein the main body side fixing bracket includes at least one first engaging piece, the coil side fixing bracket includes at least one second engaging piece, and one of the at least one first engaging piece and one of the at least one second engaging piece are configured to be fixed and detached in a snap-fit manner, by rotating at least one of the metallic main body casing or the coil portion.

7. The centrifugal pump of claim 6, wherein the at least one first engaging piece is arranged at a periphery of the main body side fixing bracket.

8. The centrifugal pump of claim 6, wherein the at least one second engaging piece is arranged at a periphery of an opening of the coil side fixing bracket.

9. The centrifugal pump of claim 1, further comprising, an upper bearing member which is disposed in the upper main body casing and supports an upper part of an axial member of the rotating blade member, and a lower bearing member which is disposed in the lower main body casing and supports a lower part of the axial member of the rotating blade member, wherein a connecting passage, which connects the fluid introducing passage and the rotating accommodating space, is formed in the upper bearing member.

10. The centrifugal pump of claim 9, wherein the axial member of the rotating blade member is fixed on the upper bearing member and the lower bearing member, and the rotating blade member is configured such that the rotating blade member is rotated around an outer periphery of the axial member.

11. The centrifugal pump of claim 10, wherein a rotating part between the rotating blade member and the axial member include synthetic resin having a high slidability.

12. The centrifugal pump of claim 9, wherein the axial member is fixed at the rotating blade member, and the rotating blade member and the axial member are rotated jointly between a top portion of the axial member and a lower end portion of the axial member.

13. The centrifugal pump of claim 12, wherein a rotating part between the upper bearing member, the lower bearing member, and the axial member include synthetic resin having a high slidability.

* * * * *